US007014344B2

(12) United States Patent
Goraguer

(10) Patent No.: US 7,014,344 B2
(45) Date of Patent: Mar. 21, 2006

(54) LIGHT GROUP FOR VEHICLE HEADLIGHT

(75) Inventor: Daniel Goraguer, Rouen (FR)

(73) Assignee: Holophane, Les Andelys (FR)

( * ) Notice: Subject to any disclaimer, the term of this patent is extended or adjusted under 35 U.S.C. 154(b) by 81 days.

(21) Appl. No.: 10/486,106

(22) PCT Filed: Aug. 5, 2002

(86) PCT No.: PCT/FR02/02803

§ 371 (c)(1),
(2), (4) Date: Feb. 9, 2004

(87) PCT Pub. No.: WO03/014618

PCT Pub. Date: Feb. 20, 2003

(65) Prior Publication Data

US 2004/0202008 A1 Oct. 14, 2004

(30) Foreign Application Priority Data

Aug. 10, 2001 (FR) ..... 01 10854

(51) Int. Cl.
*F21V 21/00* (2006.01)

(52) U.S. Cl. ..... 362/374; 362/538

(58) Field of Classification Search ..... 362/507, 362/306–307, 311, 433, 441, 455, 538, 374
See application file for complete search history.

(56) References Cited

U.S. PATENT DOCUMENTS 1,377,197 A 5/1921 Godley
1,589,143 A * 6/1926 Godley ..... 362/374
1,781,729 A * 11/1930 Major ..... 292/114
2,499,555 A * 3/1950 Wronkowski ..... 362/293
5,119,276 A 6/1992 Suzuki
6,525,890 B1 * 2/2003 Wang et al. ..... 359/896
6,554,453 B1 * 4/2003 Rao ..... 362/277
2001/0002167 A1 5/2001 Rao

FOREIGN PATENT DOCUMENTS

FR 2 651 588 A 3/1991
GB 624 909 A 6/1949

* cited by examiner

OTHER PUBLICATIONS

Patent Abstract of Japan vol. 2000, No. 05, Sep. 14, 2000.

*Primary Examiner*—Sandra O'Shea
*Assistant Examiner*—Robert May
(74) *Attorney, Agent, or Firm*—Sughrue Mion, PLLC

(57) ABSTRACT

Lighting assembly for a vehicle headlight having a reflector (1) defining a recess for a lamp; a cover glass (2) having a back face (21) facing the reflector and a front face (22); and a cover glass support part (3) secured to the reflector (1), the support part being provided with fixing device (4, 35) for holding the cover glass (2) securely in place on said support part (3). The fixing device (4, 35) has at least one member (4) forming a pressing contact portion (41) and an actuator portion (42) so as to bring the pressing contact portion into pressed contact against the cover glass (2) by moving the actuator portion, the support part (3) forming an abutment against which the cover glass rests on its front face, the pressing contact portion coming into pressed contact against the back face of the cover glass so as to push the cover glass against the abutment surface or points of the support part. Advantageously, the assembly is provided with two members disposed, for example, in diametrically opposite manner.

15 Claims, 4 Drawing Sheets

LIGHT GROUP FOR VEHICLE HEADLIGHT

The present invention relates to a lighting assembly which may be integrated into a light, and in particular into a vehicle headlight. However, the lighting assembly may be integrated into any type of light or may even constitute a light itself.

Conventionally, such a lighting assembly comprises a reflector defining a recess serving to receive a lamp; a cover glass having a plane or slightly convex back face facing the reflector and a front face; and a cover glass support part secured to the reflector, said support part being provided with fixing means for holding the cover glass securely in place on said support part. In general, the cover glass support part is a part that is separate from the reflector and that is mounted on the reflector by suitable fastening means. However, variants exist in which the cover glass support part is made in one piece with the reflector.

A first object of the present invention is to improve fixing of the cover glass onto its support part. Various fixing techniques already exist that make it possible to hold the cover glass securely on the support part. A first prior art solution consists in positioning the cover glass with its back face in abutment against an abutment surface formed by the support part. In order to hold the cover glass in place, the support part forms a band with deformable catches that come into engagement with the front face of the cover glass. More precisely, in a conventional configuration, the cover glass has a substantially plane peripheral collar on its front face with a light dome extending from said collar. The catches of the band come into engagement with the peripheral collar. A second solution of the prior art consists in positioning the cover glass with its front face in abutment against an abutment surface formed by the support part. In order to hold the cover glass securely, a resilient split ring which is placed in pressing contact against the back face of the cover glass. In order to hold the split ring, the support part forms projections extending inwards and below which the split ring can relax elastically in order to urge the cover glass against the abutment surface of the support part. A third solution consists in using a bayonet locking system: in which case, a bayonet ring pushes the cover glass against an abutment surface against which the cover glass comes into contact via its front face. A more complicated fourth solution provides a system of clamps to be folded over to come into contact with the front face of the collar of the cover glass. A series of catches are then folded over to come into abutment against the clamps in contact with the cover glass. The clamps in contact with the cover glass have a deformation characteristic so that any excessive pressure from the catches generates deformation of the clamps rather than breaking of the cover glass.

In all of the prior art solutions, it is however necessary to use an appropriate tool for fixing the cover glass to its support part in automated manner. In addition, it is frequent with certain prior art solutions for the cover glass to be urged excessively by the fixing means, which results in the cover glass being broken on being fitted. That applies particularly to fixing using a split ring which relaxes suddenly when in contact with the cover glass. The shock generated by the ring relaxing suddenly can cause the glass of the cover glass to rupture. The same applies in the solution using resilient catches: it is then frequent for the catches to be stressed or pushed excessively, thereby rupturing the cover glass.

An object of the invention is to remedy the above-mentioned drawbacks by defining fixing means for fixing the cover glass to the support part that remove any risk of the cover glass rupturing or breaking when it is put under pressure, and that, in addition, can be implemented without special tools. The fixing means may even be implemented manually without the robustness or quality of the fixing being different from the robustness or quality obtained with automatic assembly.

To this end, the present invention makes provision for the fixing means to comprise at least one member forming a pressing contact portion and an actuator portion so as to bring the pressing contact portion into pressed contact against the cover glass by moving the actuator portion, the support part forming an abutment surface (or abutment points) against which the cover glass rests on its front face, the pressing contact portion coming into pressed contact against the back face of the cover glass so as to push the cover glass against the abutment surface or points of the support part. Advantageously, the assembly is provided with two members disposed, for example, in diametrically opposite manner. Advantageously, the member is resiliently flexible at least in part, so that the pressing contact portion and/or the actuator portion is/are capable of undergoing elastic deformation when the pressing contact portion is in pressing contact against the cover glass. The pressing contact portion of the member serves to perform the functions that are performed by the resilient catches, by the split ring, or by the bayonet ring of the prior art configurations by coming to press against the cover glass. However, none of the prior art configurations incorporates actuator means for bringing the pressing contact portion into pressed contact against the cover glass. In contrast, in the present invention, the actuator portion is an integral portion of the fixing means, and, as a result, it is not necessary to provide any special tool for using the fixing means, since they are already integrated in part into the fixing means in the form of the actuator portion. In addition, because the member is resiliently flexible at least in part, the member acts as a sort of shock absorber, preventing the cover glass from being subjected to any shock, and also from being subjected to any excess load which is taken up by the member deforming elastically. Thus, all risks of the cover glass being ruptured or broken are avoided.

Advantageously, the member is mounted to pivot about a pivot axis. In which case, the pressing contact portion is brought into pressed contact against the cover glass by causing the actuator portion to pivot about the pivot axis. The actuator portion then serves as a lever making it possible to increase the pressing force from the pressing contact portion on the cover glass. For this purpose, it is necessary merely to provide an actuator portion whose length to the pivot axis is considerably longer than the length of the contact portion to the pivot axis. Advantageously, the pivot axis is situated between the pressing contact portion and the actuator portion. Thus, the actuator portion joins the pressing contact portion at the pivot axis. In addition, by providing an actuator portion that is relatively long, said actuator portion participates even more easily in elastically deforming the member which makes it possible to take up any excess load at the cover glass. Naturally, it is also possible to devise a member whose pivot axis is situated at one end of the member, e.g. at the end of the pressing contact portion, so that the actuator portion extends in alignment with the other end of the pressing contact portion.

Advantageously, the fixing means are provided with locking means in order to prevent the actuator portion from turning when the pressing contact portion is in pressed contact against the cover glass. The actuator means can be brought into the locking means either manually or automatically. It is easy to understand that a very simple tool makes it possible to bring the actuator portion into the locked position. In addition, the quality of fixing naturally remains identical, regardless of whether the actuator portion is actuated manually or automatically.

According to another characteristic, the fixing means are provided with abutment means for limiting pivoting of the pivotally mounted member in the direction in which the pressing contact portion moves away from the cover glass. It is thus possible to prevent the actuator portion from pivoting freely into positions in which it is no longer possible to take hold of the actuator portion automatically, and in which it is very difficult to take hold of the actuator manually. The fixing process is thus easy to automate.

According to a characteristic that is particularly advantageous, especially for economic reasons, the pivotally mounted member is made at least in part from a metal wire having an elastic deformation characteristic. In a variant, or additionally, the pivotally mounted member is made at least in part of a resilient blade. For example, the pivotally mounted member may be made from a stainless steel wire that is shaped or folded appropriately. In a variant, the pivotally mounted member may also be made integrally in one piece with the cover glass support. The pivot pin may then be implemented in the form of bridges of material connecting the member to the remainder of the support part. When a wire is used, the pivotally mounted member forms two pivot pin stubs engaged in pin receptacles formed by the support part. However, the pivot pin may also be formed by a portion of the wire other than at its ends. This depends on the shape and configuration of the pivotally mounted member.

In another aspect of the invention that can be implemented independently of the means for fixing the cover glass, the support part is also provided with fastening means making it possible to fix the support part to the reflector, said reflector forming a peripheral collar which projects radially outwards, said collar being situated on a connection edge serving to receive the support part, the fastening means comprising a clip mounted to pivot about a pivot axis defined at the support part, said clip comprising a fastening hook serving to pivot into engagement behind the projecting collar of the reflector, so as to press the support part securely against the connection edge of the reflector. Advantageously, the pivotally mounted clip is made at least in part from a metal wire having an elastic deformation characteristic. In a variant or additionally, the pivotally mounted clip is made at least in part from a resilient blade. In another preferred embodiment using a metal wire, the pivotally mounted clip forms two pivot pin stubs engaged in pin receptacles formed by the support part. The pivot pin may however also be formed by a portion of the wire other than its ends. This depends on the shape and configuration of the clip. In practical manner, the lighting assembly may be provided with two pivotally mounted clips disposed in diametrically opposite manner on the support part. For the pivotally mounted clips, the same elastic deformation property is used to achieve reliable fixing that can be implemented manually or automatically, in very simple manner.

The invention is described more fully below with reference to the accompanying drawings which show an embodiment of the invention by way of non-limiting example.

Figure 1:
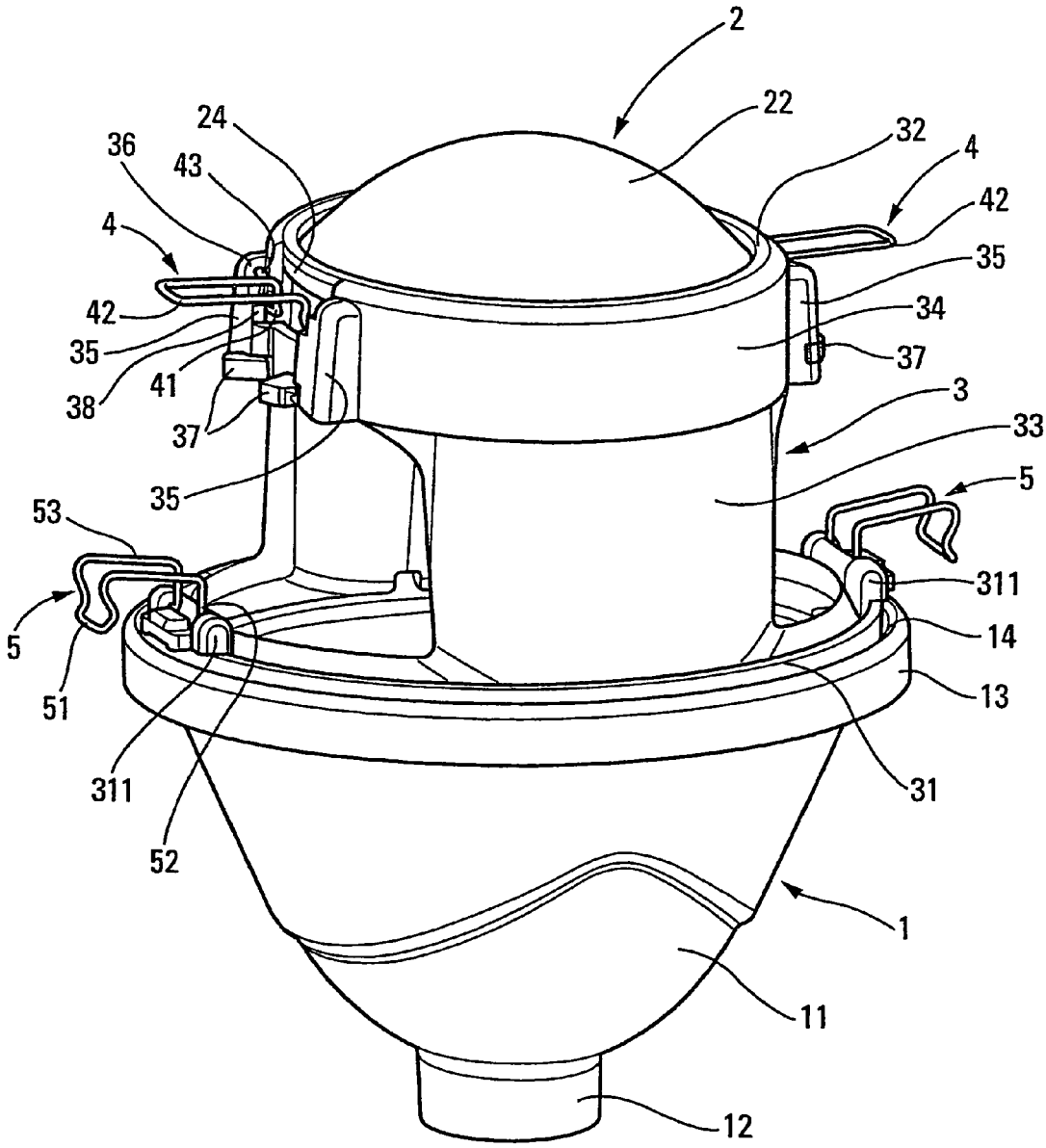
FIG. 1 is a perspective view of a lighting assembly of the invention with the fixing and fastening means in the open position.

The lighting assembly shown in the drawings is designed to be integrated into a vehicle headlight: it therefore constitutes a vehicle light component. However, a lighting assembly of the invention may also be integrated into some other type of lighting device which is not designed to be mounted on a vehicle, such as a lighthouse light, for example. It is possible to consider other applications for the lighting assembly of the invention.

The lighting assembly of the invention essentially comprises three component elements, namely a reflector 1, a cover glass 2, and a support part 3 which may commonly be referred to as an "intermediate part" because it is situated between the reflector 1 and the cover glass 2. The present invention relates particularly to the support part which supports the cover glass 2.

The reflector 1 may be an entirely conventional reflector comprising a reflector dome 11 that is substantially elliptical and that is provided with a reflective inside wall. At its bottom end, the reflector 1 forms a recess 12 serving to receive a lamp, e.g. via a lamp holder fixed to the reflector. The reflector also has an end that is wide open and that forms a connection edge 14 externally defining a collar 13 which projects radially outwards.

The reflector 1 may be made of glass, of plastic, or of metal. The reflective wall inside the dome 11 may be formed by metal-plating.

The cover glass 2 may be an entirely conventional cover glass provided with a plane or substantially plane back face 21 and with a convex front face 22. The cover glass 2 also forms a rim 24 only the edge of which is shown in the figures. The rim 24 surrounds the convex portion 22 of the cover glass. In conventional manner, the rim 24 is used to fix the cover glass 2 to the support part 3.

The support part 3 may be made of a plastics material (thermoplastics or thermosetting plastics), or of metal (cast or sheet metal).

Figure 2:
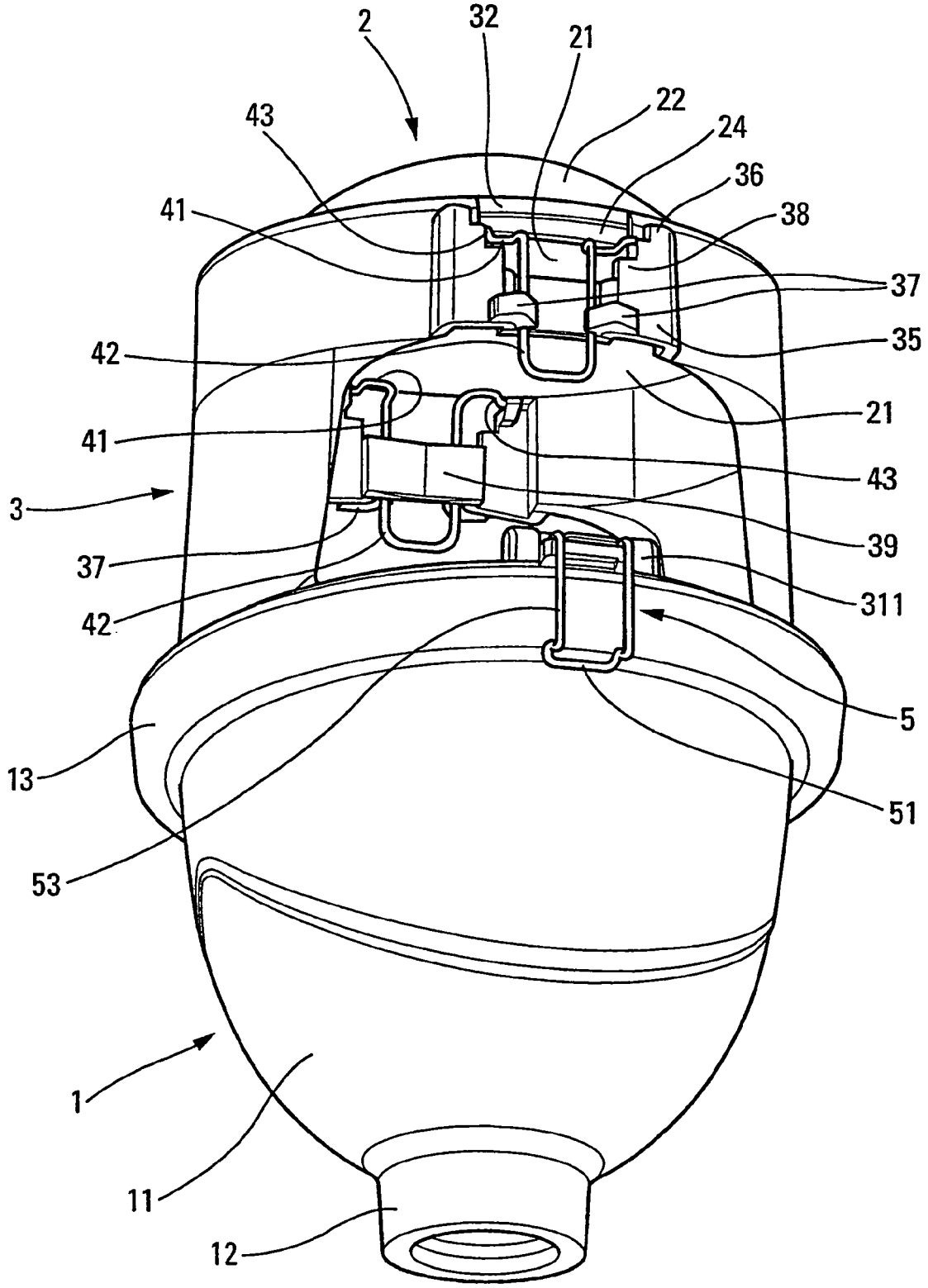
FIG. 2 is a view comparable to the FIG. 1 view, with the fixing and fastening means in the closed position.

The support part 3 holds the cover glass 2 securely, and optionally positions it angularly. The support part is also mounted securely on the connection edge 14 of the reflector 1. It has an annular base 31 adapted to come into substantially snug contact with the connection edge 14 of the reflector. The annular base 31 is also provided with fastening means 5 making it possible to hold the support part 3 securely on the reflector 1. The base 31 is provided, preferably in integral one-piece manner, with two bearing appendages 311, each of which defines a respective axis of rotation. In this example, the fastening means 5 are in the form of two clips, each of which is made of a shaped metal wire that is folded in half to form a substantially U-shaped clip. The two free ends of the wire form respective pivot pin stubs 52 engaged in the bearing appendices 311. Therefore, the fastening means or clips are mounted to pivot on bearing appendages 311 about their respective pin stubs 52. Each of the fastening means or clips 5 is also provided with a respective fastening hook 51 which is situated substantially at the web of the U. The fastening hook 51 is connected to the pin stubs 52 via two substantially parallel interconnection rods 53. The interconnection rods 53 are of length adapted so that the fastening hooks 51 of the clips 5 can come into advantageously snap-fastening engagement behind the projecting collar 13 formed by the reflector 1 at its connection edge 14. The metal wire used to make the clips 5 advantageously has an elastic deformation characteristic so that the clip can deform elastically to reach its position in which it is in snap-fastening engagement behind the collar 13, as can be seen in FIG. 2. In order to reach this position, it is necessary merely to pivot or turn the clip 5 about its pin stubs 52 from the position shown in FIG. 1 to the position shown in FIG. 2.

In the embodiment shown in the drawings, the clips 5 are made of a metal wire, e.g. of stainless steel. However, other materials may be considered for making the clips 5: e.g. it is possible to make the clips 5 from a shaped-section resilient blade also forming a fastening hook, pin stubs and an interconnection portion. It is also possible to consider making the clips 5 from a molded plastics material. Other materials, such as resins, may also be used. In the example shown in the Figures, two such clips are provided. However, it is possible to use a single clip or more than two clips.

By means of the pivotally-mounted resilient clips, it is no longer necessary to provide means for taking up tolerance since the resilient characteristic of the clips makes it possible to achieve such compensation. In addition, it should be noted that it is very easy to close the clips onto the collar 13 of the reflector 1 and such closure can be effected manually. However, automated closure is preferred, merely involving the use of machines that are very simple because it is necessary merely to bring the clip 5 down onto reflector 1. In addition, regardless of whether this is performed manually or in automated manner, the fixing quality remains the same.

Above its base 31, the support part 3 forms two flanges 33 that are connected to a band 34 which, at its top end, defines an inwardly extending lip 32 which inwardly defines a bearing surface or bearing points for receiving the front face of the rim 24 of the cover glass 2.

In the invention, the band 34 is provided with fixing means 4 making it possible to hold the cover glass 2 securely in pressed contact against the inwardly extending lip 32 on the band 34. The fixing means comprise two moving members 4, each of which defines a pressing contact portion serving to come into pressed contact against the back face 21 of the cover glass, and an actuator portion 42 which makes it possible to bring the pressing contact portion into contact with the back face 21 of the cover glass. It is thus necessary merely to act on the actuator portion in order to fix the cover glass by means of the pressed contact from the pressing contact portion against the bottom face 21 of the cover glass.

In the embodiment shown in the figures, the moving member 4 is a member mounted to pivot about a pivot axis that is fixed relative to the support part 3. The pivot axes of the moving members 4 are situated diametrically opposite each other and they extend parallel to each other in a manner such as to be substantially tangential to the band 34, and therefore also tangential to the edge of the cover glass 2. More precisely, the support part 3 forms two buttresses 35 one on either side of the cover glass. Therefore, two buttresses are provided for each pivotally mounted member 4. Each buttress 35 forms a pivot pin bearing 36. The two pivot pin bearings 36 of each pivotally mounted member 4 cooperate to define the pivot axis 36 of the pivot member 4. The buttresses 35 may be made integrally with the support part 3.

Figure 3:
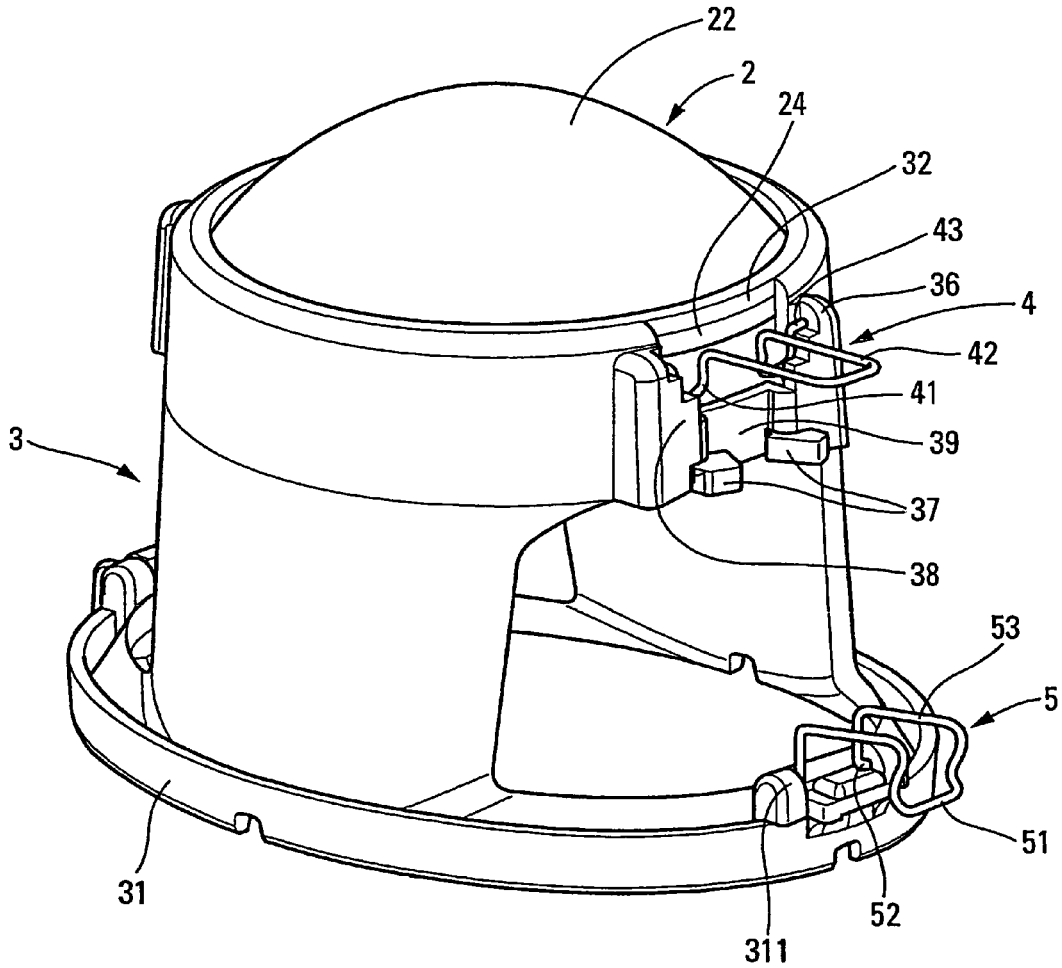
FIG. 3 is a perspective view of a cover glass support with a cover glass mounted in it, the fixing and fastening means being in the open position.
Figure 4:
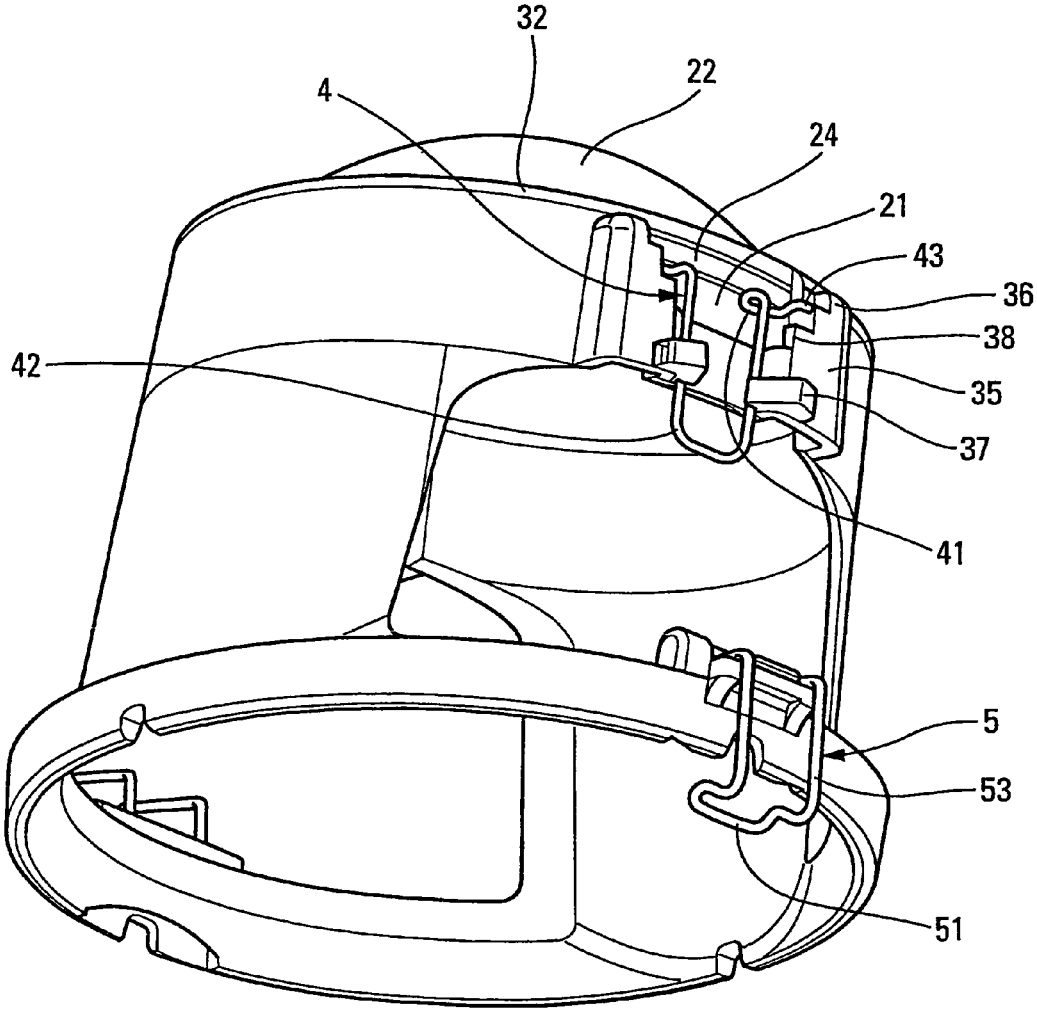
FIG. 4 is a view comparable to the FIG. 3 view with the fixing and fastening means being shown in the closed position.

The pressing contact portion 41 and the actuator portion 42 of each pivotally mounted member 4 can thus rotate about the pivot axis defined by the bearings 36. It is thus possible, by causing the actuator portion 42 to pivot through a certain angle, to bring the pressing contact portion 41 into pressed contact against the bottom face 21 of the cover glass. In FIGS. 1 and 3, the actuator portions 42 of the pivotally mounted members 4 extend substantially horizontally, i.e. substantially perpendicularly to the axis of symmetry of the lighting assembly. In this position, the pressing contact portions 41 are spaced apart from the back face 21 of the cover glass: they are even completely clear of the passageway, enabling the cover glass 2 to be removed from its seat under the inwardly extending lip 32. Therefore, in the position shown in FIG. 3, the cover glass 2 can be put in place inside the support part 3 by inserting it through the base 31. In the position shown in FIGS. 1 and 3, the pivotally-mounted members 4 are in a maximum abutment position defined by abutment flanges 38 formed by the buttresses 35 and behind which the pressing contact portions 41 come into abutment. Therefore, it is not possible to cause the actuator portions 42 to pivot further above the horizontal as shown in FIGS. 1 and 3. Starting from this maximum position, the actuator portions 42 can be pivoted downwards so as to bring the pressing contact portions 41 under the cover glass 2 until they come into pressed contact against the bottom or back face 21 of the cover glass. This is shown in FIGS. 2 and 4.

Advantageously, the pivotally mounted members 4 are resilient at least in part: they can therefore deform elastically either at the pressing contact portion or at the actuator portion, or else both at the pressing contact portion and at the actuator portion. Therefore, the actuator portion 42 can be pivoted further through a certain angle once the pressing contact portion is in contact with the cover glass. The additional pivoting is made possible by the elastic deformation characteristic of the pivotally mounted member and it makes it possible for pressed contact against the cover glass to be achieved without however exerting a pressure that is too high that could cause the cover glass to rupture or break. This avoids any risk of the cover glass being damaged while it is being fixed to the support part. It is also easy to modify or adapt the pressing force that needs to be exerted on the cover glass by acting on the type or thickness of the material used for the pivotally mounted members 4, on the length of the actuator portion, or on the shape of the members.

In the invention, the actuator portion 42, which serves as a lever making it possible to increase the pressing force at the cover glass, is locked in the position in which the pressing portion presses against the cover glass via locking teeth 37 formed by the buttresses 35. In order to penetrate between the teeth 37, the actuator portion 42 of the pivotally mounted member 4 undergoes slight deformation that is facilitated by a cam profile formed by the outside surfaces of the teeth 37. Once in engagement behind the teeth 37, the actuator portion 42 is securely locked in position, with the pressing contact portion 41 strongly pressed against the bottom or back face 21 of the cover glass so that the cover glass 2 is pressed securely against the inwardly extending lip 32 of the band 34.

In the embodiment shown in the figures, the pivotally mounted members 4 are made of metal wire, e.g. of stainless steel. Each pivotally mounted member 4 is formed from a segment of wire that is suitably bent into a U-shape. The free ends of the wire form pivot pin stubs engaged in the bearings 36 formed by the buttresses 35. The two pin stubs 43 formed by the wire extend in opposite directions and together define the pivot axis of the pivotally mounted member 4. Beyond the pin stubs 43, the wire is extended by two segments forming the pressing contact portion 41. Said two segments are situated eccentrically relative to the pin stubs 43. The wire is then extended to form the actuator portion 42. The actuator portion 42 extends substantially perpendicularly to the two segments forming the pressing contact portion 41. It is difficult to describe precisely the exact shape of the pivotally mounted member as regards the angular positioning of the various segments. In the figures, one possible embodiment is shown, but said embodiment should not be considered to be the only possible embodiment. It is possible to implement a pivotally mounted member that has a different configuration: in order to achieve the functions of a pivotally mounted member of the invention, it is necessary merely for the pivotally mounted member to have an actuator portion that is suitable for bringing a pressing contact portion into contact with the cover glass by pivoting about a pivot axis.

It is also possible to consider making a pivotally mounted member otherwise than from a metal wire. For example, it is possible to imagine a pivotally mounted member formed entirely or partly from a resilient blade. It is even possible to imagine implementing the pivotally mounted member integrally with the support part 3. It is also possible to imagine making the pivotally mounted member from a plastics material or from a resin. The example shown in the figures has two members, but it is possible to provide a single member, or else more than two members.

In a different embodiment, it is possible to imagine a moving member that is not mounted to pivot, but rather that is mounted to move in translation, but still incorporating a pressing contact portion and an actuator portion for bringing the pressing contact portion into engagement with the cover glass.

The pivotally mounted embodiment made from a shaped metal wire constitutes the preferred embodiment, for various reasons: metal wire is inexpensive, easy to work, extremely robust, very resistant to heat, very simple to put in place on the support piece, and also very simple to remove from the support piece, e.g. merely by cutting the actuator portion.

It should also be noted that the pivot axis is situated between the pressing contact portion and the actuator portion: more precisely, the actuator portion and the pressing contact portion pivot about the pivot axis with their ends. Thus, by acting on the length of the actuator portion, the lever effect is modified, thereby making it possible to increase or to decrease the pressing force on the cover glass.

By using the fixing means of the invention, the cover glass is fixed stably while avoiding any risks of it breaking. In addition, manual or automatic assembly is very simple without having any effect of the quality of the fixing. The fixing system is very inexpensive and easy to remove.

It should be noted that the means for fixing the cover glass (members 4) can be implemented independently of the fastening means (clip 5) for fixing the support part to the reflector, and vice versa. Therefore, the two means (fixing means and fastening means) can be protected separately.

The invention claimed is:

1. A lighting assembly for a vehicle headlight, said assembly comprising:

a reflector (1) defining a recess (12) serving to receive a lamp;

a cover glass (2) having a back face (21) facing the reflector and a front face (22); and a support part (3) secured to the reflector (1), said support part being provided with a fixing means (4, 35) for holding the cover glass (2) securely in place on said support part (3);

said lighting assembly being characterized in that the fixing means (4, 35) comprise at least one member (4) forming a pressing contact portion (41) and an actuator portion (42) so as to bring the pressing contact portion into pressed contact against the cover glass (2) by moving the actuator portion; and the support part (3) forming an abutment surface (32) against which the front face (22) of the cover glass (2) abuts, the pressing contact portion (41) coming into pressed contact against the back face (21) of the cover glass so as to push the cover glass (2) against the abutment surface (32) of the support part (3).

2. A lighting assembly according to claim 1, in which the member (4) is resiliently flexible at least in part, so that the pressing contact portion and/or the actuator portion is/are capable of undergoing elastic deformation when the pressing contact portion is in pressing contact against the cover glass.

3. A lighting assembly according to claim 1, in which the member (4) is mounted to pivot about a pivot axis (43).

4. A lighting assembly according to claim 3, in which the pivot axis (43) is situated between the pressing contact portion (41) and the actuator portion (42).

5. A lighting assembly according to claim 3, in which the fixing means are provided with a locking means (37) in order to prevent the actuator portion (42) from rotating when the pressing contact portion (41) is in pressed contact against the cover glass (2).

6. A lighting assembly according to any one of claims 3 to 5, in which the fixing means are provided with an abutment means (38) for limiting pivoting of the pivotally mounted member (4) in the direction in which the pressing contact portion (41) moves away from the cover glass (2).

7. A lighting assembly according to claim 3, in which the pivotally mounted member (4) is made at least in part from a metal wire having an elastic deformation characteristic.

8. A lighting assembly according to claim 3, in which the pivotally mounted member (4) is made at least in part of a resilient blade.

9. A lighting assembly according to claim 3, in which the pivotally mounted member (4) forms two pivot pin stubs (43) engaged in pin receptacles (36) formed by the support part (3).

10. A lighting assembly according to claim 1, comprising at least two members (4).

11. A lighting assembly according to claim 1, in which the support part (3) is provided with fastening means (5, 311) making it possible to fix the support part (3) to the reflector (1), said reflector forming a peripheral collar (13) which projects radially outwards, said collar (13) being situated on a connection edge (14) serving to receive the support part, the fastening means comprising a clip (5) mounted to pivot about a pivot axis (52) defined at the support part, said clip (5) comprising a fastening hook (51) serving to pivot into engagement behind the projecting collar (13) of the reflector, so as to press the support part securely against the connection edge of the reflector.

12. A lighting assembly according to claim 11, in which the pivotally mounted clip (5) is made at least in part from a metal wire having an elastic deformation characteristic.

13. A lighting assembly according to claim 11, in which the pivotally mounted clip (5) is made at least in part from a resilient blade.

14. A lighting assembly according to claim 11, in which the pivotally mounted clip (5) forms two pivot pin stubs (52) engaged in pin receptacles formed by the support part.

15. A lighting assembly according to claim 11, provided with at least two pivotally mounted clips (5).

* * * * *